US011338982B2

(12) United States Patent
Buhl

(10) Patent No.: US 11,338,982 B2
(45) Date of Patent: May 24, 2022

(54) PACKAGING PART FOR SECURING AN ITEM TO BE PACKED IN AN OUTER PACKAGING

(71) Applicant: Buhl-PaperForm GmbH, Burbach (DE)

(72) Inventor: Christoph Buhl, Neunkirchen (DE)

(73) Assignee: Buhl-PaperForm GmbH, Burbach (DE)

( * ) Notice: Subject to any disclaimer, the term of this patent is extended or adjusted under 35 U.S.C. 154(b) by 0 days.

(21) Appl. No.: 17/248,149

(22) Filed: Jan. 11, 2021

(65) Prior Publication Data

US 2021/0214144 A1 Jul. 15, 2021

(30) Foreign Application Priority Data

Jan. 13, 2020 (DE) ..... 10 2020 100 515.6

(51) Int. Cl.
*B65D 81/05* (2006.01)

(52) U.S. Cl.
CPC ..... *B65D 81/052* (2013.01); *B65D 2581/053* (2013.01); *B65D 2581/055* (2013.01)

(58) Field of Classification Search
CPC ..... B65D 81/052; B65D 2581/053; B65D 2581/055
USPC ..... 206/586, 592, 594
See application file for complete search history.

(56) References Cited

U.S. PATENT DOCUMENTS 1,958,050 A * 5/1934 Koppelman ..... B65D 65/44 162/116
2,863,595 A * 12/1958 Emery ..... B65D 81/133 229/406
3,101,166 A * 8/1963 Van Antwerpen ..... B65D 5/504 206/454
3,231,454 A * 1/1966 Williams ..... F16F 9/0481 428/132
3,266,705 A * 8/1966 Wood ..... B65D 81/1275 206/523
3,575,781 A * 4/1971 Pezely ..... B65D 81/03 428/180
3,870,152 A * 3/1975 Kaplan ..... B65D 81/053 206/523
3,975,564 A * 8/1976 Jones ..... B65D 81/056 428/174

(Continued)

FOREIGN PATENT DOCUMENTS

CH 383260 A 10/1964
DE 10124470 A1 3/2002

(Continued)

*Primary Examiner* — Jacob K Ackun
(74) *Attorney, Agent, or Firm* — Smartpat PLC

(57) ABSTRACT

A packaging part (1) for securing an item to be packaged in an outer packaging, has at least one supporting body (2, 16) that acts as a decoupling element. The supporting body is formed as a hollow body and projects from a bearing base. The supporting body (2, 16) has a base with a relatively large cross-section in the area of the bearing base and tapers in a direction away from the bearing base. The supporting body (2, 16) further has in its shell surface at least one line of weakness (14) that divides the supporting body into an upper part and a lower part. The upper part of the supporting body (2, 16) can be pressed along the line of weakness (14), preferably completely, into the lower part under load.

14 Claims, 6 Drawing Sheets

(56) References Cited

U.S. PATENT DOCUMENTS

| | | | | | |
|---|---|---|---|---|---|
| 4,241,829 | A * | 12/1980 | Hardy | B65D 5/563 | 206/523 |
| 5,622,262 | A | 4/1997 | Sadow | | |
| 5,826,726 | A * | 10/1998 | Yang | B65D 81/057 | 206/586 |
| 6,029,962 | A | 2/2000 | Shorten et al. | | |
| 6,471,067 | B1 | 10/2002 | Lancaster | | |
| 6,968,954 | B2 * | 11/2005 | Hsieh | B65D 81/133 | 206/586 |
| 8,887,916 | B2 | 11/2014 | Gilfert et al. | | |
| 9,315,312 | B2 * | 4/2016 | De Luca | B65D 81/3888 | |
| D793,862 | S | 8/2017 | Buhl et al. | | |
| 2002/0017805 | A1 | 2/2002 | Carroll et al. | | |
| 2003/0038054 | A1 * | 2/2003 | Hurley | B65D 81/056 | 206/586 |
| 2010/0253114 | A1 | 10/2010 | Ohmiya et al. | | |
| 2011/0062040 | A1 * | 3/2011 | Rich | B65B 55/20 | 206/453 |

FOREIGN PATENT DOCUMENTS

| | | | |
|---|---|---|---|
| DE | 69811251 | | 3/2003 |
| DE | 102012102432 | A1 | 9/2012 |
| EP | 1138611 | A1 | 10/2001 |
| EP | 1985553 | A1 | 10/2008 |
| EP | 3141495 | A1 | 3/2017 |
| GB | 1379652 | A | 1/1975 |
| WO | 9802367 | A1 | 1/1998 |
| WO | 02102460 | A2 | 12/2002 |

* cited by examiner

PACKAGING PART FOR SECURING AN ITEM TO BE PACKED IN AN OUTER PACKAGING

CROSS-REFERENCE TO RELATED APPLICATION

This application claims priority of German patent application No. DE 10 2020 100 515.6, filed 2020 Jan. 13, the contents of which are incorporated by reference.

TECHNICAL FIELD

The disclosure relates to a packaging part for securing an item to be packaged in an outer packaging, that is it relates to an inner packaging part.

BACKGROUND

Such inner packaging parts are mostly manufactured as cast parts from so-called "molded fiber" and are usually individually adapted to the contour of the item to be secured in the outer packaging. Cast parts that are at least predominantly formed from paper fibers, in particular from waste-paper fibers, are referred to as molded fiber cast parts. They serve to secure the item to be packaged in the outer packaging and to protect it against impact. Such cast parts can be designed to meet the requirements of the item to be secured, both in terms of geometry and fiber properties, and are therefore particularly suitable as technical packaging.

An inner packaging part formed as an edge protector for a plate-shaped or frame-shaped item is known, for example, from US D 793,862 S.

A two-part packaging body made of foamed plastic is known from CH 383260. It is divided longitudinally and/or transversely and is provided with at least one cavity that is essentially adapted to the contour of the respective goods to be packaged. The packaging body known from this publication is characterized, in particular, in that rib-shaped supports formed by recesses and/or cutouts are provided on the packaging body in order to increase the resilience and flexibility of the packaging body.

DE 101 24 470 A1 discloses a method and a device for cushioning an item and for protecting an item during transport. The packaging device includes a shaped body having a first elasticity. The shaped body has a number of recesses arranged on a first side of the shaped body. An insert having an elasticity greater than the elasticity of the shaped body is introduced into at least one of the recesses. The insert is preferably made of a foam polymer.

U.S. Pat. No. 8,887,916 B2 discloses an inner packaging part for protecting an array of glass bottles in an outer packaging. Such inner packaging part is also individually adapted to the number, size and arrangement of the bottles to be transported.

SUMMARY

A packaging part or an inner packaging for securing and protecting an item to be transported can be used as a universally applicable protective packaging. The packaging part is intended in particular to cushion the impact loads that, under certain circumstances, are exerted on the item to be transported.

The packaging part for securing an item to be packaged in an outer packaging has at least one supporting body acting as a decoupling element. The supporting body is formed as a hollow body and protrudes from a bearing base or a flat bearing surface. The supporting body has a base with a relatively large base cross-section in the area of the bearing base and tapers in the direction away from the bearing base, that is, in a distal direction. The supporting body further comprises in its shell surface at least one line of weakness or predetermined breaking line or buckling edge, which divides the supporting body into an upper part and a lower part. The upper part of the supporting body can be pressed along the line of weakness preferably completely into the lower part under load. The line of weakness can be formed at least partially circumferentially in the shell surface of the supporting body. Alternatively, a multiple number of lines of weakness or buckling edges can be formed in the shell surface of the supporting body to allow the supporting body to be selectively pressed in under load. Although the term "line of weakness" is predominantly used in the context of this description, it is also to be understood to include a predetermined breaking line, a buckling line or a buckling edge.

The packaging part is preferably formed such that it deforms essentially irreversibly under load. That way, the supporting body is correspondingly pressed in under load and has the effect of stabilizing the item to be transported transversely with respect to the direction of loading. The part of the supporting body that forms the base is hereinafter designated as the lower part of the supporting body. The part of the supporting body that forms the tapered tip is hereinafter designated as the upper part of the supporting body.

The term "beveled surface" is synonymous with "beveled shell surface," in particular of a polyhedron. The term "polyhedron" is used synonymous with "polyhedron-shaped supporting body."

In principle, the tapered tip of the supporting body can be flattened. Alternatively, the tapered tip of the supporting body can be formed to be roof-like or ridge-like. The line of weakness in the shell surface of the supporting body can extend approximately parallel to the bearing base. However, it can also be provided that at least one line of weakness extends at an angle or in an arc with respect to the bottom of the bearing base.

With a preferred variant of the packaging part, the hollow body volume of the lower part of the supporting body is preferably dimensioned such that the lower part of the supporting body can accommodate the volume of the upper part of the supporting body at least partially, preferably completely. If the lower part of the supporting body at least partially absorbs the material of the upper part of the supporting body under load, this causes the stabilization of the lower part of the supporting body that is not pressed in.

The packaging part can essentially comprise a single supporting body and a bearing base, which can be formed either over the entire surface or as a circumferential, flange-like collar of the supporting body. A multiple number of packaging parts so formed can, for example, be placed in an outer packaging at specific locations provided for this purpose, such as in the corners of a cardboard box. A larger item can then be stored in a selective manner using a multiple number of individual packaging parts.

However, a preferred variant of the packaging part s is formed as a mat-shaped insert for an outer packaging or as a cushioning mat or cushioning web with which the item to be stored can be wrapped. Such an insert, cushioning mat or cushioning web can, for example, be provided in prefabricated sizes. This is ideally formed to be stackable.

In order to ensure the stackability of the insert, the supporting bodies are expediently formed extending from the bearing surface or bearing base of the insert in such a manner that the supporting bodies are each open in the area of their base, that is, at the bearing base, downwards or counter to the formed direction.

The at least one supporting body can have a geometry selected from a group of geometries comprising dome-shaped, cusp-shaped, cupola-shaped, sphere-shaped, truncated cone-shaped, pyramid-shaped, truncated pyramid-shaped, prism-shaped, or other polyhedron-shaped geometries. Other round or oval geometries are also envisioned.

With a particularly preferred variant of the packaging part the at least one supporting body has a polyhedron-shaped geometry with surfaces extending obliquely with respect to the bearing base.

The line of weakness of the at least one supporting body can be formed, for example, in a shoulder of the shell surface of the at least one supporting body or by a step in the shell surface of the at least one supporting body. The line of weakness can be in the form of a predetermined breaking line or a predetermined buckling line.

Preferably, at least one shell surface of the at least one supporting body is at least partially perforated. For example, if the supporting body has a polyhedral geometry, a beveled surface of the supporting body can be perforated in a window-like manner. If the supporting body is dome-shaped or cupola-shaped, that is, it has an essentially round, rotationally symmetrical geometry, at least one cutout can be formed in an oblique cut of the shell surface of the supporting body.

The cut-out preferably extends in a plane inclined with respect to the bearing base. If the at least one supporting body is polyhedron-shaped, it is advantageous if the perforated beveled surface of the at least one supporting body is steeper with respect to the bearing base or has a greater angle than the other supporting surfaces. This makes it easier to press in a closed beveled surface opposite the perforated beveled surface. By pressing in the at least one supporting body, in particular by a force acting obliquely thereon, the material of the at least one supporting body is pressed in, in particular above the line of weakness, into the cavity located thereunder, where it folds in a wave shape or pleats, as the case may be. The supporting body pressed in in this manner forms a buffer against forces acting laterally.

If the at least one supporting body has a polyhedron-shaped geometry, it is advantageous if one of the beveled surfaces of the polyhedron is inclined in an angular range of between 40° and 80° with respect to the plane of the bearing base.

Preferably, the cast part is formed of papier mâché, cardboard, molded fiber, sheet metal, plastic, e.g. a polymer foam, or combinations of such materials.

The beveled surfaces of the at least one supporting body can each have a different inclination with respect to the plane of the bearing base.

A plurality of supporting bodies may be arranged to form a mat-shaped insert. Each of supporting bodies has at least one perforated beveled surface and/or has beveled surfaces of different inclination. The supporting bodies are alternately arranged in each case in a manner rotated by, for example, 180° with respect to one another about an axis that is perpendicular with respect to the bearing base. The supporting bodies could also be oriented in the same direction or rotated in any angular position relative to each other at the bearing base. Advantageously, the supporting bodies are arranged relative to each other such that the perforated beveled surfaces of adjacent supporting bodies are aligned in rows or columns in opposite directions.

With a variant of the packaging part, it is provided that the mat-shaped insert has a circumferential edge that is formed by supporting bodies that are less flexible under load than the other supporting bodies. In this manner, it can be achieved that an item to be supported on the insert settles under load in such a manner that it is secured by the circumferential edge of the insert against laterally acting forces and against slipping.

Within the frame formed by the circumferential edge, for example, the supporting bodies can be arranged in diagonally extending rows.

The following detailed description is merely exemplary in nature and is not intended to limit the invention or the application and uses of the invention. Furthermore, there is no intention to be bound by any theory presented in the preceding background or the following detailed description.

DETAILED DESCRIPTION

Figure 1A:
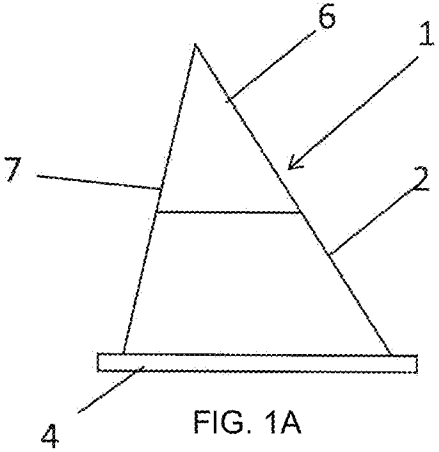
FIGS. 1 A-D are various views of a first variant of a packaging part.
Figure 1B:
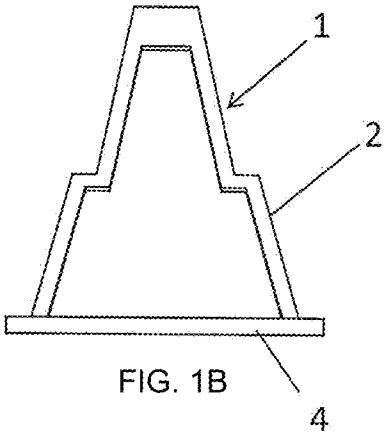
Figure 1C:
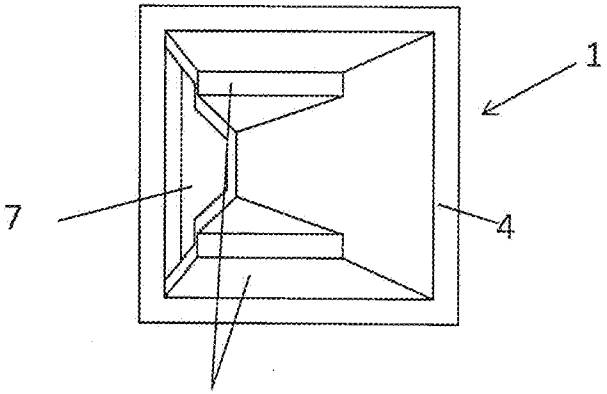
Figure 1D:
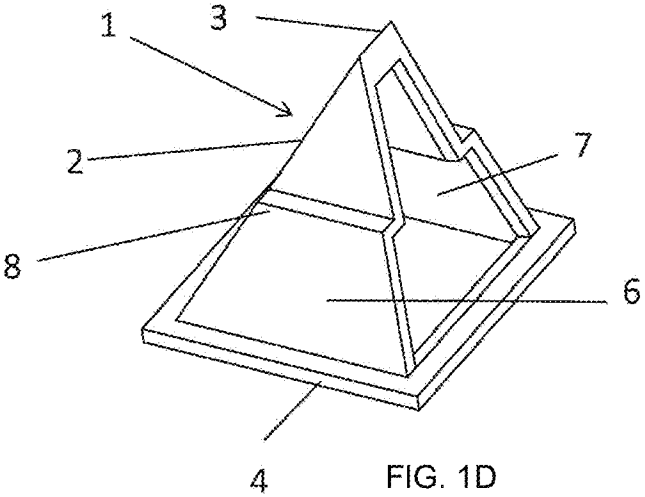
Figure 2F:
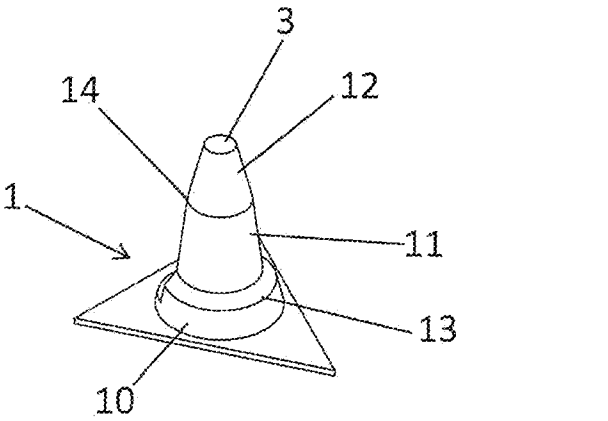
FIGS. 2 A-G are various views of a second variant of a packaging part.
Figure 2G:
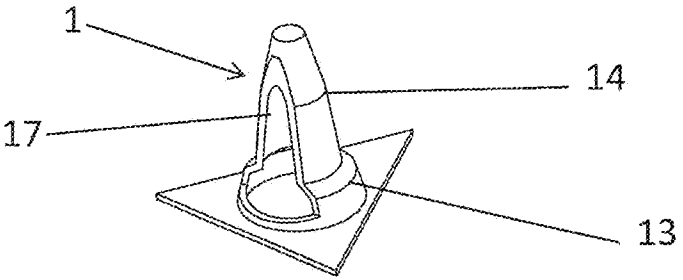
Figure 2D:
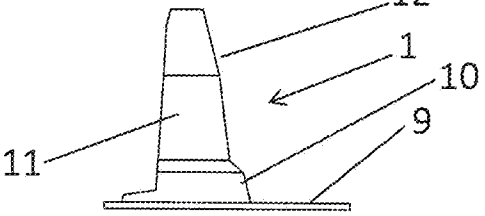
Figure 2C:
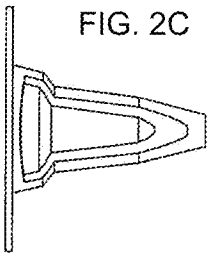
Figure 2A:
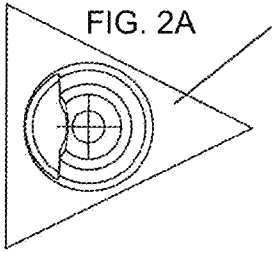
Figure 2B:
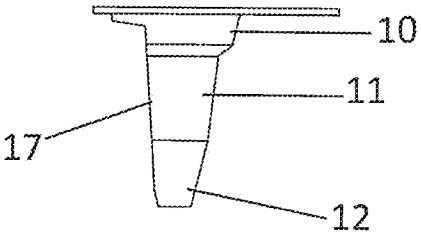
Figure 2E:
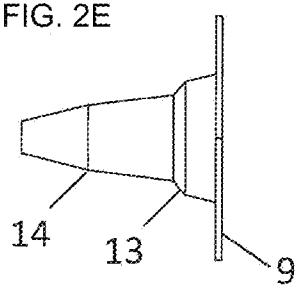

Reference is initially made to FIGS. 1A-D which shows a first variant of a packaging part. The packaging part 1 shown in FIGS. 1A-D can both be arranged as a single packaging part 1 between an item to be packaged and an outer packaging, and also as a part of an insert 15 shown, for example, in FIGS. 3 A-E and FIGS. 4 A-E. In the former case, it is useful to store the goods or item to be packaged on a multiple number of packaging parts 1 having the configuration shown, for example, in FIGS. 1A-D.

In the simplest case, the packaging part 1 comprises a supporting body 2, which is formed as a pointed hat-shaped hollow body made, for example, of wastepaper molded fiber. The supporting body 2 has a base with a relatively large rectangular, in the present case square, base cross-section. A circumferential, flange-like collar 4 is provided at the base of the supporting body 2, forming a bearing base. Alternatively, the supporting body 2 can be arranged on a base plate of any desired design. The supporting body 2 tapers in the direction of a ridge-like tip 3. For example, in the simplest case, the supporting body 2 can be placed with the flange-like collar 4 on the bottom of a cardboard box as an outer package. The ridge-like tip 3 then supports the item to be placed in the outer packaging, wherein the supporting body 2 serves in this manner as a decoupling element for the item to be stored. If the packaging part 1 is formed as a mat-shaped insert 15, as shown for example in FIGS. 3 A-E and FIGS. 4 A-E, the bearing base is formed by a perforated grid-shaped lower side of the insert 15, as will be described further below.

In accordance with FIGS. 1A-D, the supporting body 2 is exemplarily formed as a polyhedron-shaped hollow body (polyhedron). It has four converging beveled surfaces 6 rising from the collar 4, which, as shown in particular in FIG. 1A, extend at different angles in relation to the plane of the bearing base or to the plane spanned by the collar 4. That beveled surface which extends at a relatively steep angle with respect to the bearing base is provided with a cutout 7. The beveled surface 6 of the supporting body 2 opposite the cutout 7 has a relatively smaller inclination with respect to the bearing base. The other two beveled surfaces 6 each have a shoulder 8 forming a bend edge (line of weakness), which extends approximately parallel to the collar 4 or to the bearing base, as the case may be. The shoulders 8 each form a line of weakness or predetermined buckling line of the shell surface of the supporting body 2, which divides the supporting body into a lower part with a relatively large base cross-section and an upper part with a relatively smaller base cross-section.

In the case of forces acting perpendicularly or obliquely on the tip 3 of the supporting body 2, for example due to the weight of the item to be packaged/transported, the upper part of the supporting body 2 can be pressed into the lower part of the supporting body 2, depending on the level of the load. The material of the supporting body 2 is preferably irreversibly deformed in the process. The hollow body volume of the lower part of the supporting body 2 is dimensioned such that the lower part of the supporting body can accommodate the volume of the upper part of the supporting body 2 at least partially, but typically completely. The different inclination of the opposing closed and perforated beveled surfaces 6 favors the pressing in of the tip 3 of the supporting body, in such a manner that the upper part of the supporting body 2 folds within the hollow volume of the lower part of the supporting body 2, stabilizing the lower part of the supporting body 2 in the process.

A second embodiment of a packaging part 1 is shown in FIGS. 2 A-G. Identical parts of the packaging part 1 are provided there with the same reference signs. The supporting body 2 shown in FIGS. 2 A-G rises from a triangular base plate 9. The base plate can have any other desirable contour. The supporting body 2 has a round base cross-section and is essentially rotationally symmetrical. Starting from the base plate 9, which is a bearing base, the supporting body 2 tapers in the direction of the tip 3. Starting from the base plate in the direction of the tip 3, the supporting body 2 is divided overall into three conical sections. Those include a base cone 10 with a relatively large base cross-section, a central cone 11 extending above the base cone 10, and a truncated cone 12 forming the tip 3. The central cone 11 is offset with respect to the base cone 10 by a slanted shoulder 13 or shoulder 13 inclined in the direction of the base plate 9. The shoulder 13 forms a circumferential buckling edge. The truncated cone 12 is offset from the central cone 11 by an additional line of weakness 14.

The shell surface of the supporting body 2 is provided with a cut 17 extending obliquely from the base in the direction of the tip 3, which forms a cutout through the shell surface of the supporting body 2. The mode of operation of the supporting body 2 in accordance with the second embodiment shown in FIGS. 2 A-G is identical to the mode of operation of the supporting body 2 in accordance with the first embodiment. A force applied to the tip 3 of the truncated cone 12 causes the truncated cone 12 and possibly also, depending on the load, the central cone 11 to be pressed into the hollow cross-section of the base cone 10.

FIGS. 3 A-E shows an embodiment of the packaging part 1, which is formed as a mat-shaped insert for an outer packaging. Alternatively, the packaging part 1, as shown for example in FIGS. 3 A-E and FIGS. 4 A-E, can be used to wrap an item to be transported. However, the preferred application is to place the insert 15 on the bottom, on the side wall or on the lower side of the lid of an outer packaging, in such a manner that the lower side of the insert 15 forming the bearing base is turned towards the relevant side of the outer packaging.

Figure 3A:
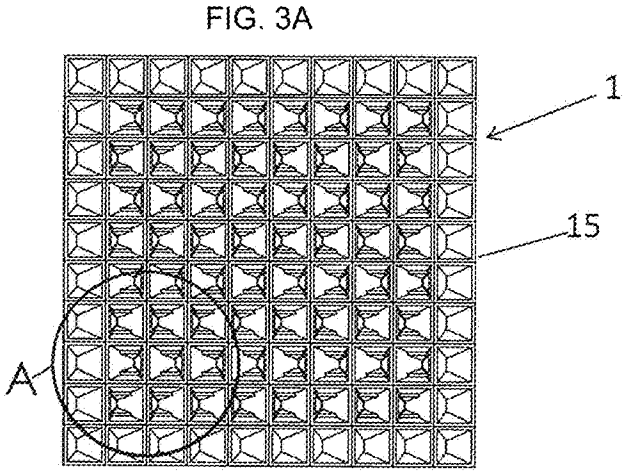
FIGS. 3 A-E are various views of a first variant of a packaging insert.
Figure 3B:
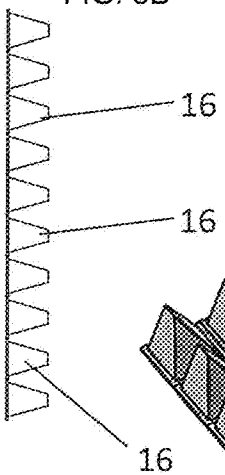
Figure 3C:
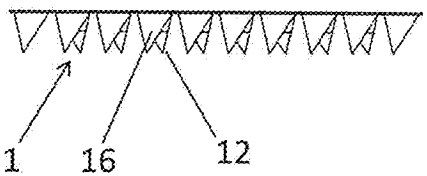
Figure 3D:
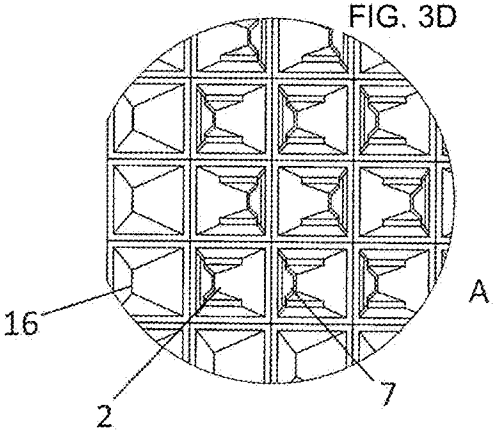
Figure 3E:
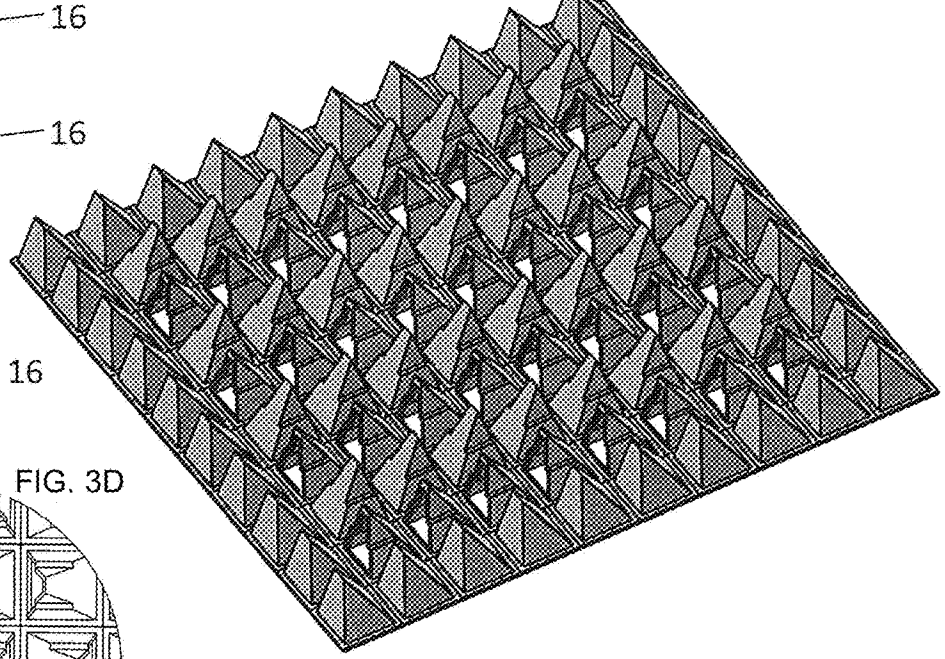
Figure 4E:
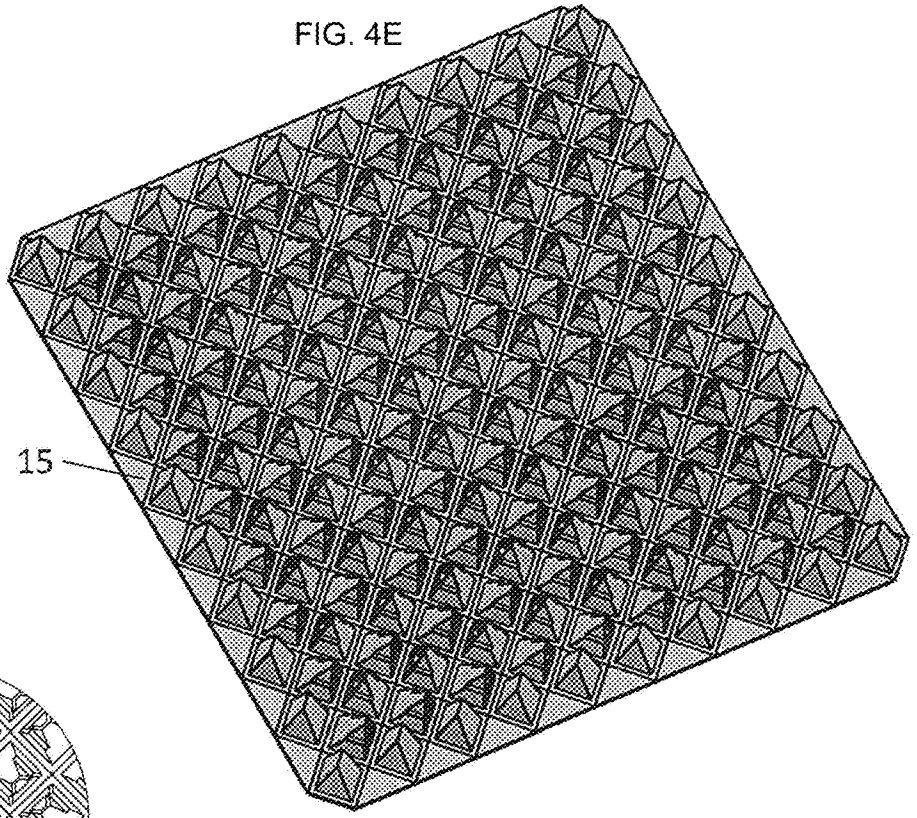
FIGS. 4 A-E are various views of a second variant of a packaging insert.
Figure 4B:
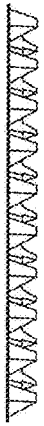
Figure 4D:
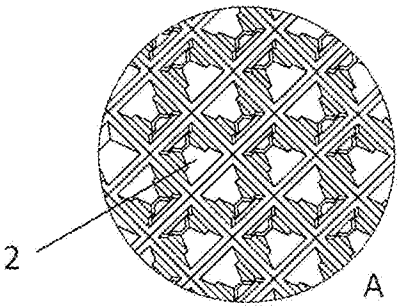
Figure 4A:
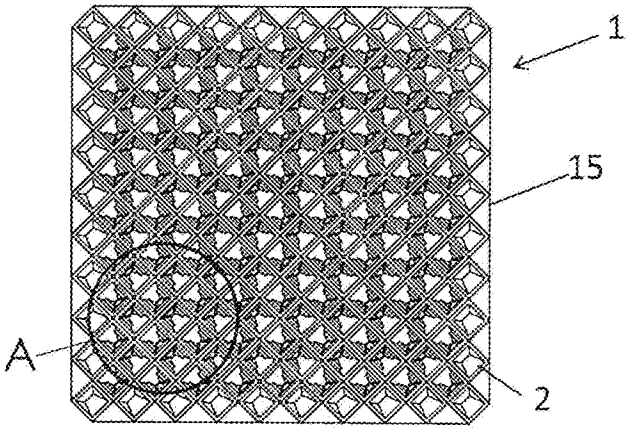
Figure 4C:
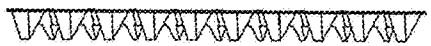

The insert 15 comprises a plurality of supporting bodies 2 that, with the exception of closed supporting bodies 16 circumferential around the edges, are formed in accordance with the supporting bodies 2 shown in FIGS. 1 A-D. The geometry of the closed supporting bodies 16 or of the supporting bodies 16 with a closed shell surface, as the case may be, corresponds essentially to the geometry of the supporting bodies 2 shown in FIGS. 1 A-D. The closed supporting bodies 16 form an edge-side bordering of the insert 15. Within the frame formed by the supporting bodies 16 arranged at the edges, the supporting bodies 2 are regularly arranged in columns and rows. The supporting bodies arranged in a row are aligned in the insert 15 in the same manner, that is, their cutouts 7 all point to one side. The supporting bodies arranged in the adjacent row are rotated by 180°, that is, their cutouts 7 all point in the opposite direction (see detail A in FIG. 3D). Column by column, the supporting bodies are thus alternately rotated by 180°. This results in the crossed arrangement of the tips 3 of the supporting bodies 2, as shown in FIG. 3C, which is advantageous in terms of the safe storage of the goods to be transported. FIG. 3E shows the insert in accordance with FIG. 3A in an enlarged perspective view. Since the supporting bodies 2, 16 are each open downwards at their base, the insert has a perforated lattice-like lower side, such that multiple inserts can be stacked one on top of the other in such a manner that the supporting bodies 2, 16 of overlapping inserts 5 penetrate one another.

FIGS. 4 A-E shows an additional variant of the insert 15, with which the supporting bodies 2 are formed and arranged as shown in FIGS. 1 A-D. The supporting bodies 2, 16 are arranged in diagonal rows relative to one another, wherein the cutouts 7 of mutually adjacent supporting bodies in a diagonal are rotated alternately by 180° relative to one another.

Figure 5A:
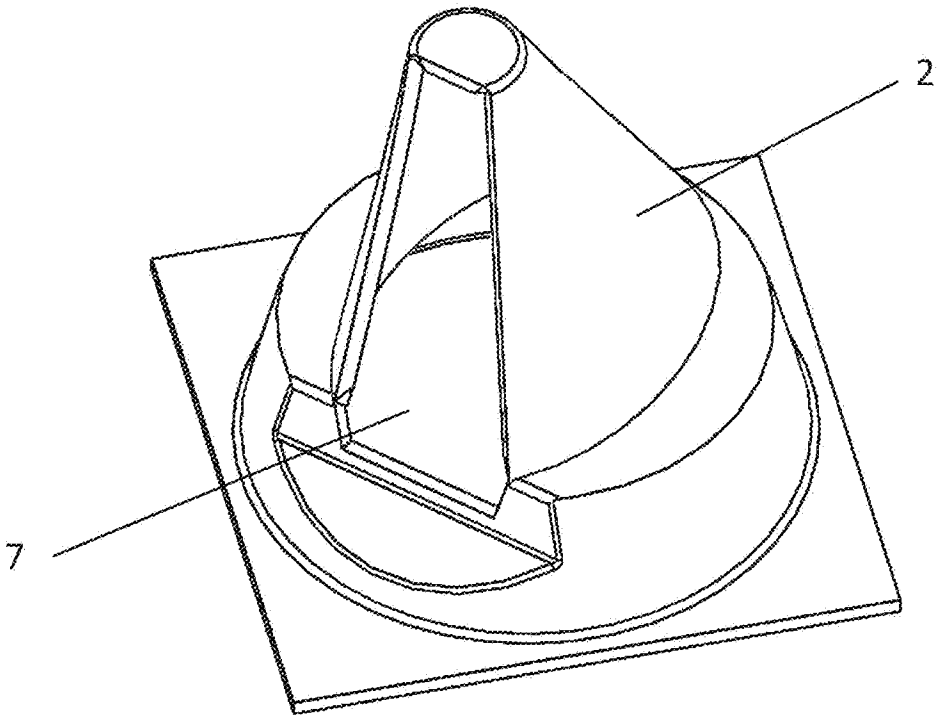
FIGS. 5A and 5B shows a third variant of a supporting body and a corresponding insert.
Figure 5B:
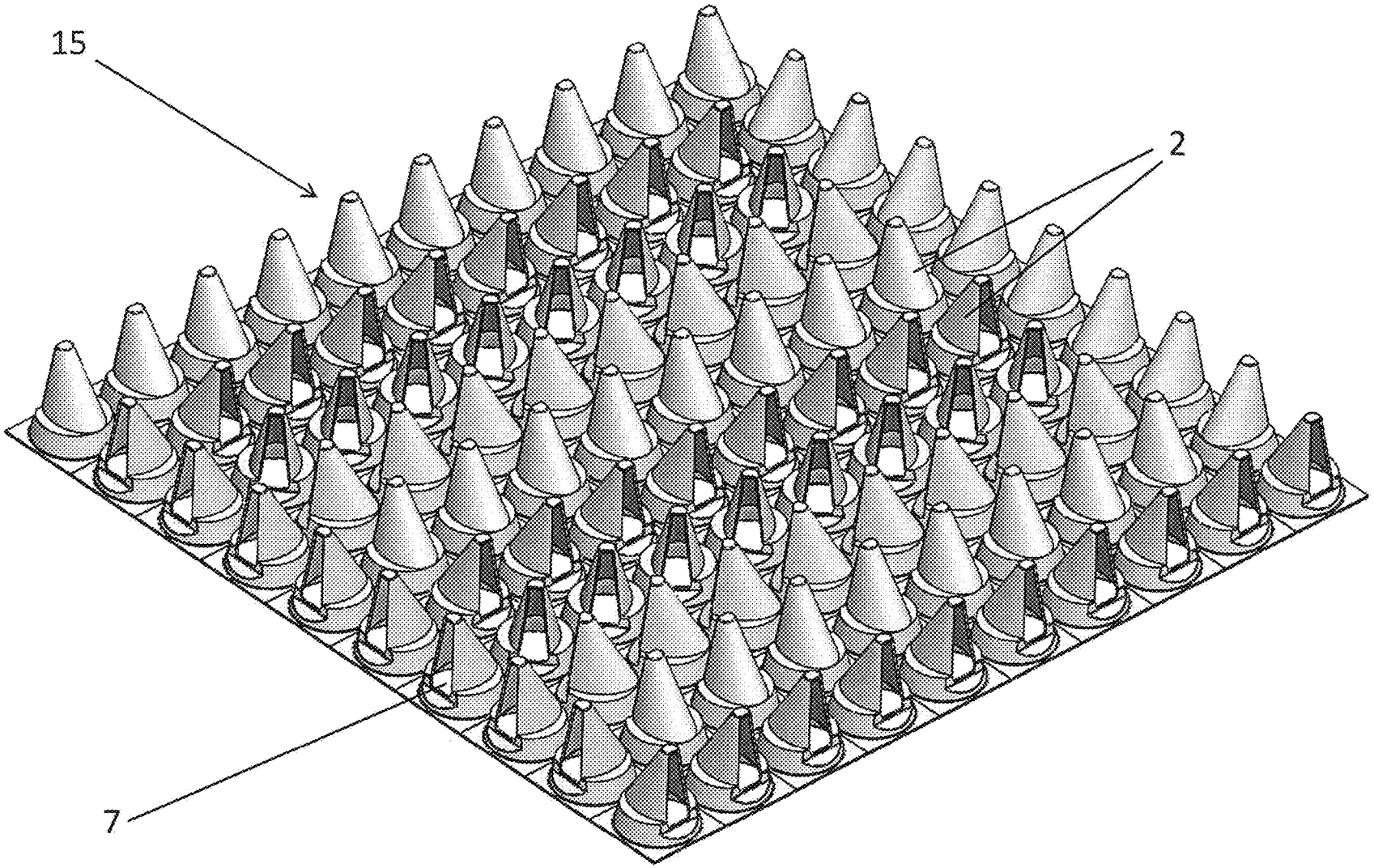

FIG. 5B shows an additional variant of the insert 15, with which the supporting bodies 2 are formed in accordance with FIG. 5A.

For all variants of the insert 15 shown in the figures, it applies that, in each case, two adjacent or opposite supporting bodies 2 can be arranged with their open cutouts 7 in any angular position relative to one another on the insert 15. However, a uniform movable relative angular arrangement should (preferably) be selected and formed for each insert 15 (optional provision).

In FIGS. 3A and 3E and FIGS. 4A and 4E, the inserts are correspondingly symmetrical. In the case of the insert in accordance with FIG. 5B, this has been deviated from.

Moreover, the formation of the border of the insert 15 from closed supporting bodies 2 without cutouts 7 in accordance with FIGS. 3A, 3E, 4A, 4E is merely optional. In the case of the insert in accordance with FIG. 5B, this has been deviated from in that the supporting bodies forming the circumferential edge of the insert are initially partially formed with cutouts.

The words "example" and "exemplary" as used herein mean serving as an instance or illustration. Any embodiment or design described herein as "example" or "exemplary" is not necessarily to be construed as preferred or advantageous over other embodiments or designs. Rather, use of the word example or exemplary is intended to present concepts in a concrete fashion. As used in this application, the term "or"

is intended to mean an inclusive "or" rather than an exclusive "or". That is, unless specified otherwise or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

While the present invention has been described with reference to exemplary embodiments, it will be readily apparent to those skilled in the art that the invention is not limited to the disclosed or illustrated embodiments but, on the contrary, is intended to cover numerous other modifications, substitutions, variations and broad equivalent arrangements that are included within the spirit and scope of the following claims.

LIST OF REFERENCE SIGNS

1 Packaging part
2 Supporting body
3 Tip of the supporting body
4 Collar
5 Insert
6 Beveled surface
7 Cutout
8 Offset
9 Base plate
10 Holder
11 Central cone
12 Truncated cone
13 Indent
14 Line of weakness
15 Insert
16 Supporting body
17 Cut

What is claimed is:

1. A mat-shaped insert (15) for securing an item to be packaged in an outer packaging, comprising:

a plurality of supporting bodies (2, 16) that act as decoupling elements, wherein each supporting body (2, 16) of the plurality of supporting bodies (2, 16) is formed as a hollow body that projects from a bearing base, and wherein each supporting body (2, 16) has a base cross-section in an area of the bearing base and tapers in a direction away from the bearing base; and a line of weakness (14) arranged in a shell surface of the supporting body (2, 16) that divides the supporting body into an upper part and a lower part, wherein the upper part of each supporting body (2, 16) is configured to be pressed along the line of weakness (14) into the lower part under load, wherein the plurality of supporting bodies (2, 16) are arranged to form the mat-shaped insert (15), each supporting body having a perforated beveled surface (6) and/or having beveled surfaces (6) of different inclination, and wherein the plurality of supporting bodies (2, 16) are arranged alternately rotated by 180° with respect to one another about an axis that is perpendicular with respect to the bearing base.

2. The mat-shaped insert according to claim 1, wherein the supporting bodies (2, 16) are arranged relative to one another in such a manner that the perforated beveled surfaces (6) of adjacent supporting bodies (2, 16) are aligned in rows or columns in opposite directions.

3. The mat-shaped insert according to claim 1, wherein the mat-shaped insert (15) has a circumferential edge that is formed by supporting bodies (16) that are less flexible to deformation under load than other supporting bodies (2).

4. The mat-shaped insert according to claim 3, wherein the supporting bodies that form the circumferential edge are formed to be at least partially closed without a cutout in their shell surfaces.

5. The mat-shaped insert according to claim 1, wherein a hollow body volume of the lower part of each supporting body (2, 16) is dimensioned such that the lower part of each supporting body (2, 16) can completely accommodate a volume of the upper part.

6. The mat-shaped insert according to claim 1, wherein the plurality of supporting bodies (2, 16) are evenly spaced from one another.

7. The mat-shaped insert according to claim 1, wherein each supporting body (2, 16) has a geometry selected from the group consisting of a dome-shaped geometry, a cusp-shaped geometry, a cupola-shaped geometry, a cone-shaped geometry, a truncated cone-shaped geometry, a pyramid-shaped geometry, a truncated pyramid-shaped geometry, a prism-shaped geometry, a polyhedron-shaped geometry, a round geometry, and an oval geometry.

8. The mat-shaped insert according to claim 1, wherein the line of weakness (14) is formed by a shoulder (8), an edge, or a bend in the shell surface of each supporting body (2, 16).

9. The mat-shaped insert according to claim 1, wherein the line of weakness (14) is formed by a double bend in the shell surface of each supporting body (2, 16).

10. The mat-shaped insert according to claim 1, wherein the shell surface or part of shell surface of the each supporting body (2, 16) is perforated.

11. The mat-shaped insert packaging part according to claim 10, wherein a cutout (7) in the shell surface of each supporting body (2, 16) extends in a plane running obliquely with respect to the bearing base.

12. The mat-shaped insert according to claim 1, wherein the mat-shaped insert it is formed as a cast part from papier mâché, cardboard, molded fiber, plastic, a polymer foam, or a combination thereof.

13. The mat-shaped insert according to claim 1, wherein each supporting body (2, 16) is shaped as a polyhedron and wherein the shell surface comprises a plurality of beveled surfaces (6), and wherein one of the beveled surfaces (6) of the polyhedron is inclined in an angular range of between 40° and 80° with respect to a plane of the bearing base.

14. The mat-shaped insert according to claim 13, wherein the one of the beveled surfaces (6) of the supporting body (2, 16) has a different inclination with respect to the plane of the bearing base than another one of the beveled surfaces (6) of the supporting body (2, 16).

* * * * *